United States Patent [19]

Mir-Heidari

[11] Patent Number: 4,990,091

[45] Date of Patent: Feb. 5, 1991

[54] ROTATING WHEEL TOY APPARATUS WITH REPLACEABLE COLORED ELEMENTS

[76] Inventor: Saeed Mir-Heidari, 27 Burgundy La., Middletown, Conn. 06457

[21] Appl. No.: 456,564

[22] Filed: Dec. 26, 1989

[51] Int. Cl.[5] ..... A63H 1/32

[52] U.S. Cl. ..... 434/98; 446/243; 446/245

[58] Field of Search ..... 434/98, 104; 446/243, 446/244, 245, 247, 253, 256, 261, 262

[56] References Cited

U.S. PATENT DOCUMENTS

| | | | |
|---|---|---|---|
| Re. 19,499 | 3/1935 | Savage | 446/245 |
| 680,957 | 8/1901 | Backus | 446/256 X |
| 838,305 | 12/1906 | Curial | 446/243 |
| 1,116,911 | 11/1914 | Orlansky | 446/253 X |
| 1,575,264 | 3/1926 | Henry | 446/256 X |
| 1,631,539 | 6/1927 | Larrair | 446/245 X |
| 1,925,136 | 9/1933 | Conover | 446/244 X |
| 2,779,129 | 1/1957 | Reyher | 446/245 |
| 3,278,182 | 10/1966 | Lescher | 446/244 X |
| 3,392,482 | 7/1968 | Nathan | 446/261 |
| 3,789,545 | 2/1974 | Mann | 446/253 |
| 4,026,042 | 5/1977 | Ames | 446/243 X |
| 4,189,862 | 2/1980 | Lopez | 446/254 |

*Primary Examiner*—Richard J. Apley
*Assistant Examiner*—Rachel M. Healey
*Attorney, Agent, or Firm*—Robert S. Smith

[57] ABSTRACT

Apparatus for teaching color combinations includes a generally cylindrical spinner member having first and second apertures extending therethrough proximate to the geometric center thereof and a loop of twine extending through the openings with a portion thereof disposed on each side of the spinner member. The apparatus also includes apparatus for securing a plurality of colored members on the circumferential surface of the spinner member. This apparatus may include other apparatus for securing comprising a plurality of pockets dimensioned and configured for receiving respective generally planar colored members.

7 Claims, 2 Drawing Sheets

ROTATING WHEEL TOY APPARATUS WITH REPLACEABLE COLORED ELEMENTS

BACKGROUND OF THE INVENTION

The invention relates to toys and particularly to toys that utilize a wheel through which pass a pair of strings to produce rotating movement by twisting of the strings. The invention has particular application to toys of this type which in addition have the purpose of teaching the effects of various color combinations.

The prior art includes various rotating wheels on which a variety of colors are disposed to illustrate the effects of mixing of the colors. Patents describing such apparatus include U.S. Pat. No. 4,026,042 and 3,953,104. The U.S. Pat. No. 3,953,104 includes a color wheel which has plurality of colorful designs provided in the wheel. The colorful display will be understood not to be disposed on the periphery as in the U.S. Pat. No. 4,026,042. The U.S. Pat. No. 4,026,042 includes a plurality of wheels. Each wheel has two colors fixed in the same continuous order.

The prior art also includes a number of members, which are usually cylindrical, through which a pair of strings extend at spaced points proximate to the axis of the cylindrical member. The strings are twisted typically by a looping motion of the cylindrical member. Thereafter, the axial extremities of the strings extending through the cylindrical member are pulled outwardly away from the cylindrical member causing the cylindrical member to rotate rapidly.

It is an object of the invention to provide apparatus which will illustrate various color combinations.

It is still another object of the invention to provide apparatus which will allow the user to select the color combinations which he wishes to observe.

It is an object of the invention which will include a wheel which has means for disposing any of a large plurality of colored segments along the periphery of the wheel.

SUMMARY OF THE INVENTION

It has now been found that these and other objects of the invention may be attained in an apparatus for teaching color combinations which includes a generally cylindrical spinner member having first and second apertures extending therethrough proximate to the geometric center thereof. The apparatus also includes a loop of twine extending through the openings with a portion thereof being disposed on each side of the spinner member and means for securing a plurality of colored members on the circumferential surface of the spinner member.

This embodiment of the apparatus in accordance with the invention may further be constructed with the means for securing comprising a plurality of pockets dimensioned and configured for receiving respective generally planar colored which may be rectangular members. The apparatus may also include a generally cylindrical sleeve member extending around the outer surface of the spinner member, and the sleeve members may be generally transparent.

In another embodiment of the invention a plurality of upstanding T-shaped cross-section members are disposed about the periphery of the spinner member, and the means for securing includes a circumferentially extending member carried on the T-shaped cross-section members and the T-shaped cross section define opposed channels for engagement with the colored members.

The T-shaped sections may have the upper most portion thereof manufactured of a metal different than the material of the remainder thereof. The sleeve member may be formed of alternate axially extending cylindrical sections which are respectively a transparent material and a second material.

BRIEF DESCRIPTION OF THE DRAWING

The invention will be better understood by reference to the accompanying drawing in which.

DESCRIPTION OF THE PREFERRED EMBODIMENT

Figure 1:
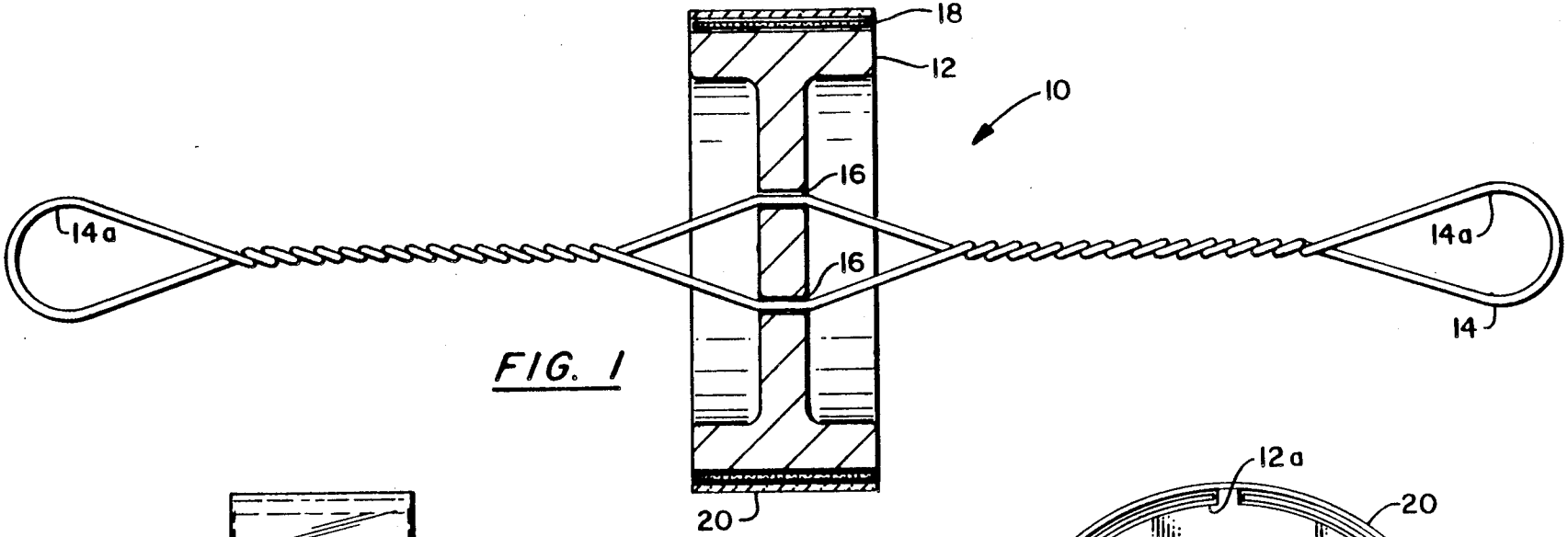
FIG. 1 is a side elevational view in partial section of the apparatus in accordance with one form of the invention.
Figure 3:
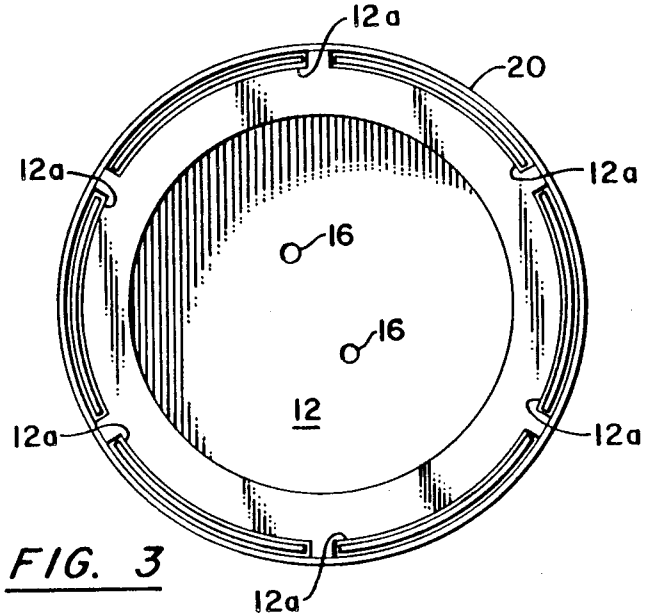
FIG. 3 is a side elevational view of the wheel illustrated in FIG. 2 which further illustrates the pockets for receiving the colored members.
Figure 2:
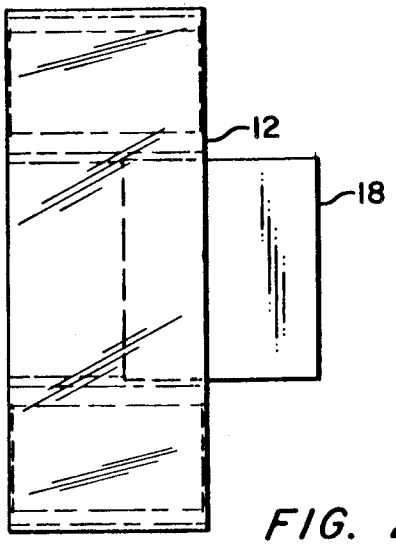
FIG. 2 is a side elevational view of the wheel illustrated in FIG. 1 and showing particularly the manner of insertion of the colored members in pockets disposed along the peripheral face of the wheel.
Figure 10:
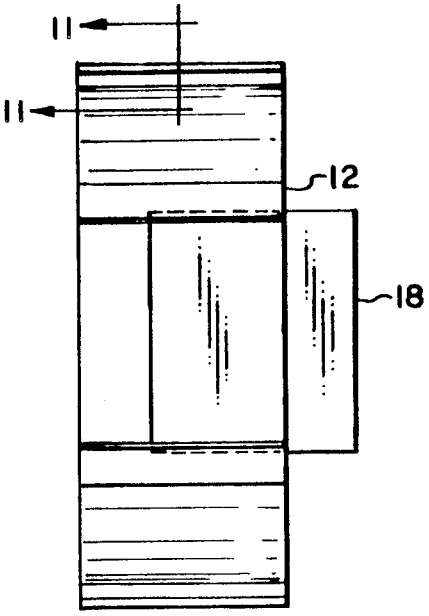
FIGS. 10 and 11 are respectively side elevational and a fragmentary sectional view taken along the line 11—11 showing an embodiment in which a single T-shaped member extends upwardly from the cylindrical member and is shaped to receive a colored member.

Referring now to FIGS. 1, 2 and 3 there is shown an apparatus in accordance with one form of the invention. The apparatus includes a generally cylindrical wheel 12 through which extends a loop of twine 14. The twine 14 extends through apertures 16, 16 in the wheel 12. The twine 14 ordinarily will be twisted in a manner shown in FIG. 1 so the user can then apply an axial force to the twisted twine 14, to cause the cylindrical member 12 to rotate.

As best seen in FIG. 3, the wheel 12 is provided with six recesses or openings **12*a* into which colored, rectangular members 18 may be inserted from the side as shown in FIG. 2. A transparent, plastic cylindrical sleeve 20 extends over the entire circumference of the wheel 12 so that the colored members 18 are cylindrically held in place in the respective recesses 12*a***.

The apparatus in accordance with the invention allows the user to insert various colored members 18 into the recesses or openings **12*a* and determine the effects of mixing the various colors and particularly the primary colors to produce other colors. Ordinarily, the apparatus will include a plurality of colored members 18 which are dimensioned and configured for insertion in the recesses 12***a*.

Figure 4:
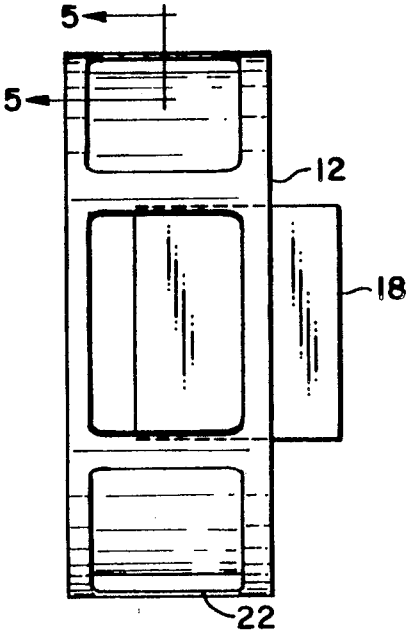
FIGS. 4 and 5 are respectively side elevational and fragmentary sectional views taken along the line 5—5 of one embodiment of the apparatus in accordance with the invention which utilizes an outer sleeve which is formed by cylindrical sections interspersed between T-shaped stand-offs.
Figure 5:
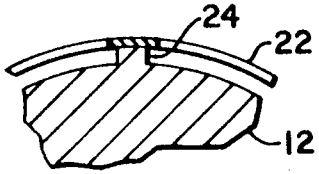

Referring now to FIGS. 4 and 5 there is shown a wheel 12 which is generally similar to the wheel 12 shown in FIGS. 1–3. In this embodiment the outer sleeve 20 is replaced by a sleeve 22 which is alternately clear plastic and an opaque material which is disposed on top (as shown) of the stand-offs 24 which separate the recesses for the members 18.

Similar embodiments are shown in FIGS. 6–11. More particularly, the embodiment illustrated in FIGS. 6 and 7 has a single transparent outer sleeve 20 as shown in FIGS. 1–3. The construction of the stand-off 24 is substantially the same as that shown in FIG. 5.

Figure 11:
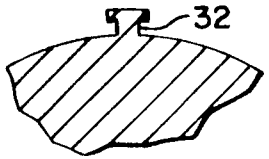
Figure 8:
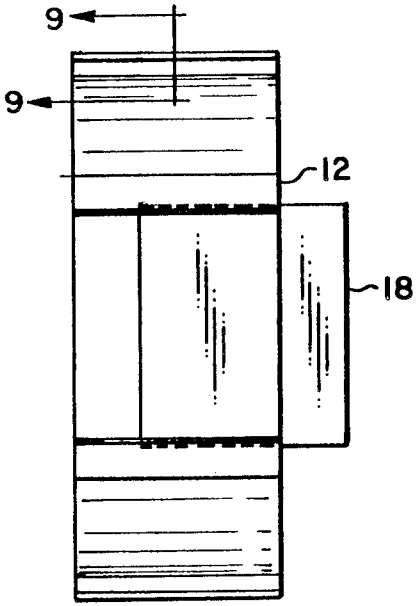
FIGS. 8 and 9 are respectively side elevational and fragmentary sectional views taken along the line 9—9 showing an embodiment in which the stand-off is provided with a cap to define slots for receiving the colored members.
Figure 9:
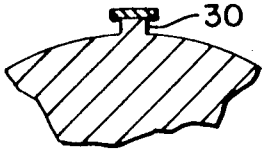
Figure 6:
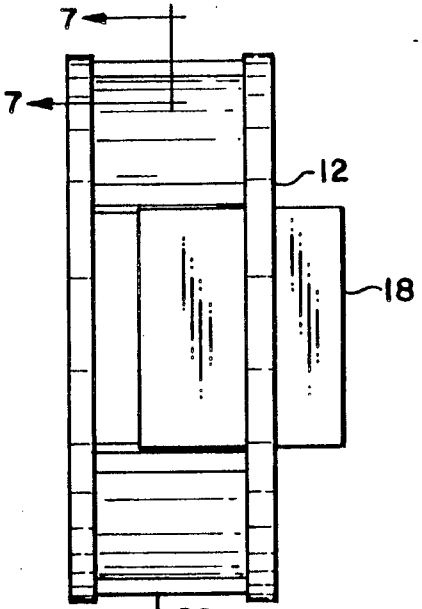
FIGS. 6 and 7 are respectively side elevational and fragmentary sectional views taken along the line 7—7 of another embodiment of the invention in which the sleeve is a single cylindrical section which surround the cylindrical member.
Figure 7:
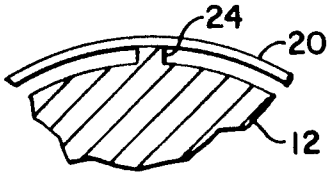

The embodiments illustrated in FIGS. 8 and 9 and FIGS. 10 and 11, are similar in that they utilize a T-shaped member 30 or 32 which supplies channels on each side for receiving the color member 18. The 2 embodiments illustrated in FIGS. 9 and 11 differ primarily in that the upper most, as viewed, portion of the member 32 is either integrally formed as shown in FIG. 11, or is separately formed and attached as best illustrated by the representation of member 30 in FIG. 9. In this embodiment the colored members 18 are secured on the face of the cylindrical member 12 with no overlying clear plastic member such as 20 or 22.

All of the embodiments allow the user to quickly and easily replace the colored members 18 and thus to produce various color combinations, and particularly, the color combinations of the primary colors. Accordingly, the apparatus is particularly constructive for students first encountering the effects of mixing various colors.

In other embodiments the wheel may be driven by an electric motor powered by batteries or line current. Such embodiments will be particularly useful for designers, decorators, and artists when selecting colors and the colors from which they are derived.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the appended claims.

Having thus described my invention I claim:

1. Apparatus for teaching color combinations comprising:

a generally cylindrical spinner member having first and second apertures extending therethrough proximate to the geometric center thereof, said generally cylindrical member having an axis and first and second faces through which said axis extends;

a loop of twine extending through said apertures with a portion thereof being disposed on each side of said spinner member; and means for securing a plurality of colored members on the circumferential surface of said spinner member, said means for securing including a plurality of pockets disposed about the circumference of said generally cylindrical spinner member, said pockets being dimensioned and configured for receiving respective generally planar, colored members, said pockets each including first and second sides, said first and second sides being respectively proximate to said first and second faces of said generally cylindrical member, said pockets each including an opening at one of said sides thereof.

2. The apparatus as described in claim 1 wherein:

said pockets are formed by a generally cylindrical sleeve member extending around the outer surface of said spinner member, said sleeve member being generally transparent.

3. The apparatus as described in claim 2 further including:

a plurality of upstanding T-shaped cross-section members disposed about the periphery of said spinner member, said means for securing includes a circumferentially extending member carried on said T-shaped cross-section members, said T-shaped cross-section members defining opposed channels for engagement with said colored members.

4. The apparatus as described in claim 3 wherein:

said T-shaped cross-section members have the upper most portion thereof manufactured of a material different than the material of the remainder thereof.

5. The apparatus as described in claim 4 wherein:

said sleeve member is formed of a plurality of axially extending cylindrical sections disposed about the periphery of said spinner member and successive sections about the periphery of said spinner member are made alternately from a transparent material and a second material.

6. The apparatus as described in claim 1 further including:

a plurality of upstanding T-shaped cross-section members disposed about the periphery of said spinner member, said T-shaped cross-section members defining opposed channels for engagement with said colored members.

7. The apparatus as described in claim 6 wherein:

said T-shaped cross-section members have the upper most portion thereof manufactured of a material different than the material of the remainder thereof.

* * * * *